US005499413A

United States Patent [19]

Van Hekken

[11] Patent Number: 5,499,413

[45] Date of Patent: Mar. 19, 1996

[54] COMPOSITE FOAM CHAIR CUSHION AND METHOD

[75] Inventor: Hendrik R. Van Hekken, Allentown, Pa.

[73] Assignee: Westinghouse Electric Corporation, Pittsburgh, Pa.

[21] Appl. No.: 235,850

[22] Filed: Apr. 29, 1994

[51] Int. Cl.[6] ..... A47C 27/00; A47C 7/02

[52] U.S. Cl. ..... 5/464; 297/452.17; 297/452.27

[58] Field of Search ..... 5/464, 653; 297/457.17, 297/452.27

[56] References Cited

U.S. PATENT DOCUMENTS

| | | | |
|---|---|---|---|
| Re. 25,943 | 12/1965 | Lawson | 297/452.17 |
| 1,742,186 | 1/1930 | Claus | 5/653 |
| 3,567,278 | 3/1971 | Barecki et al. | 297/452.17 |
| 4,248,646 | 7/1981 | Ginsburg | 156/78 |
| 4,522,447 | 6/1985 | Snyder et al. | 5/653 |
| 4,571,763 | 2/1986 | Suzuyama et al. | 5/653 |
| 4,631,768 | 12/1986 | Ferrall | 5/464 |
| 4,637,651 | 1/1987 | Sperr | 297/452.27 |
| 4,682,818 | 7/1987 | Morell | 5/464 |
| 4,696,516 | 9/1987 | Yeum | 297/452.27 |
| 4,837,881 | 6/1989 | Kondo et al. | 5/653 |
| 5,048,137 | 9/1991 | Rogers | 5/464 |
| 5,231,717 | 8/1993 | Scott et al. | 5/464 |
| 5,236,247 | 11/1993 | Hewko | 156/78 |

FOREIGN PATENT DOCUMENTS

| | | | |
|---|---|---|---|
| 2639809 | 6/1990 | France | 5/653 |
| 2522375 | 12/1976 | Germany | 5/653 |

*Primary Examiner*—Michael J. Milano
*Attorney, Agent, or Firm*—C. J. Vrsansky

[57] ABSTRACT

Disclosed is a composite foam chair cushion and method used to produce the composite chair cushion. The cushion is especially suitable for use in the construction of one and two piece office type chairs. The cushion is comprised of an insert of foamed material of predetermined density and compressibility and bonded to a foamed border material of less density and greater compressibility than that of the insert. Also disclosed is a method for producing the composite foam chair cushion of this invention using a cushion mold and a foamable reaction mixture of a foam material, such as polyurethane.

13 Claims, 3 Drawing Sheets

COMPOSITE FOAM CHAIR CUSHION AND METHOD

BACKGROUND OF THE INVENTION

This invention relates to a chair cushion and method for producing a chair cushion. It relates particularly to the manufacture of chair cushions used for one and two piece office chairs having upholstered chair seats and backs. A one piece office chair has a padded and upholstered chair seat and a padded and upholstered chair back combined as a single integral unit, usually enclosed in a molded rigid one piece plastic outer shell. A two piece office chair has the upholstered and padded chair seat and a separate, but connected, padded and upholstered chair back which are usually enclosed in two separate, but connected, molded rigid plastic outer shells.

In recent years, most chair cushions used for office type chair seats and backs were made of a soft, resilient plastic foam material, such as a polyurethane foam, that was either cut from a sheet of the foam material or custom molded to the desired shape and size. The polyurethane foam cushion was then covered with upholstery material and attached to the molded rigid plastic outer shell as part of the chair assembly.

In the past, the foam chair cushions were made of a single piece of foam material, either cut from a sheet or custom molded to the desired shape and size in a mold. The foam material used in these prior chair cushions was of a uniform density and provided a uniform soft resiliency over the entire surface of the cushion. In order to provide sufficient comfort in the seat portion, the cushions were often quite thick which often detracted from the appearance of the chair and made upholstering the cushion more difficult. While such chair cushions were simple to produce they did not always provide good comfort to the user and often would lose much of their resiliency over a period of time.

SUMMARY OF THE INVENTION

It is therefore an object of this invention to provide a chair cushion and method for producing a chair cushion that provides good comfort to the user.

It is a further object of this invention to provide a chair cushion and method for producing a chair cushion that will not lose its resiliency over a period of time.

It is a further object of this invention to provide a chair cushion and method for producing a chair cushion that allows for the chair cushion to be less bulky than prior cushions, easily upholstered and able to be custom engineered for special seating applications.

It is a still further object of this invention to provide a chair cushion and method for producing a chair cushion that can be adapted for use with many different designs of chairs and types of upholstery materials.

It has been discovered that the foregoing objects can be attained by a composite chair cushion comprised of an insert of a foamed material of a predetermined density and compressibility bonded to a foamed border material of less density and greater compressibility than that of the insert and by using a method for producing a composite foam chair cushion comprising the steps of placing a insert of foamed sheet material in a predetermined position against one face of a cushion mold, introducing a foamable reaction mixture into the mold around the border of the insert, allowing the foamable reaction material to foam within the mold and bond to the insert, and then removing the composite foam chair cushion from the mold.

DESCRIPTION OF THE PREFERRED EMBODIMENTS

Figure 1:
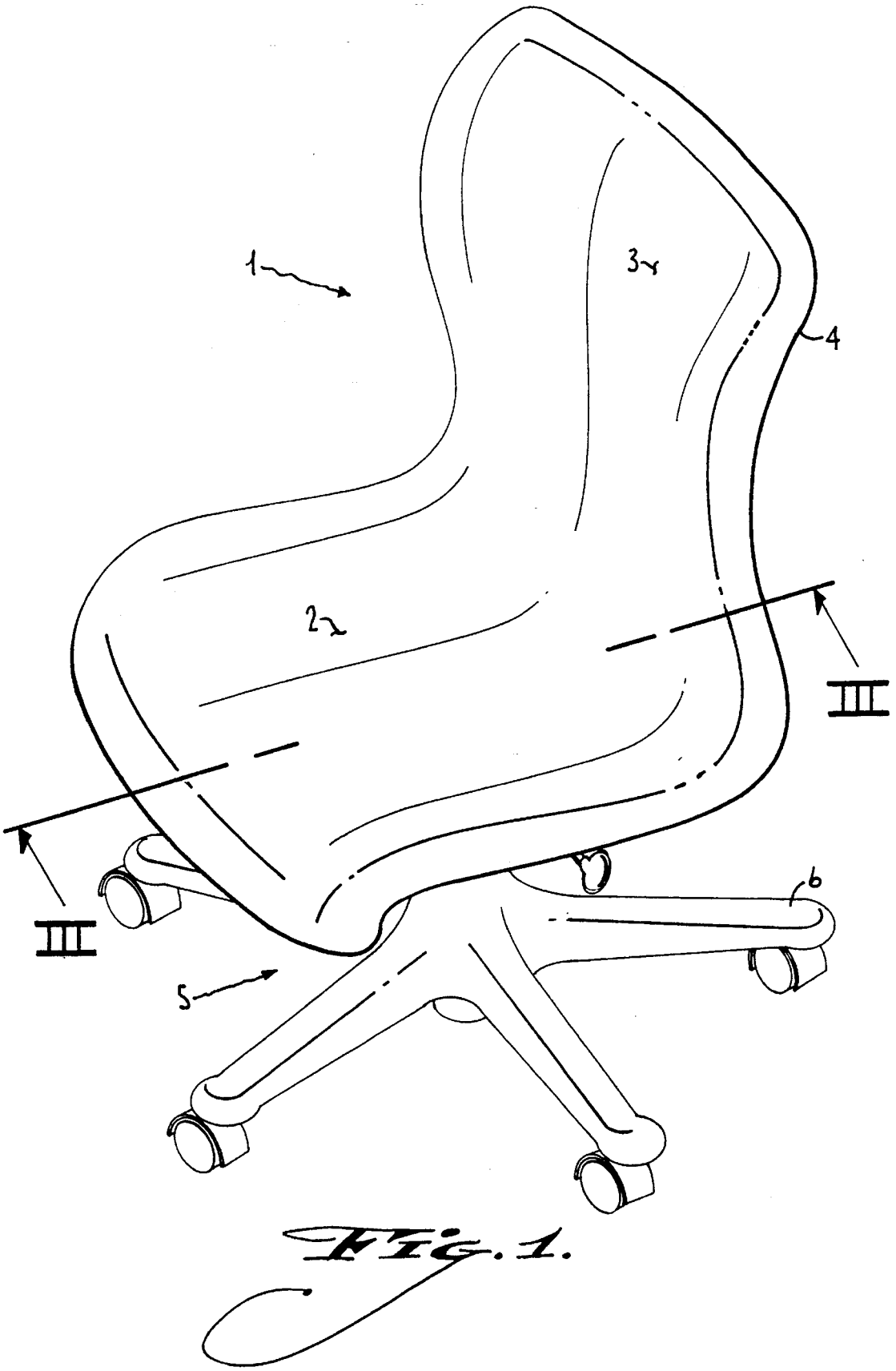
FIG. 1 is an isometric view of a typical one piece office chair manufactured using the chair cushion and method of this invention.

FIG. 1 illustrates an isometric view of a typical one piece office chair manufactured using the chair cushion and method of this invention. The typical one piece chair 1 has a padded and upholstered chair seat portion 2 and a padded and upholstered chair back portion 3 combined as a single integral unit enclosed in a one piece rigid plastic molded shell 4 that fits under the chair seat portion 2 and behind the chair back portion 3 to support the chair seat portion 2 and chair back portion 3 on a pedestal base 5 having radial legs 6 fitted with casters 7.

Figure 2:
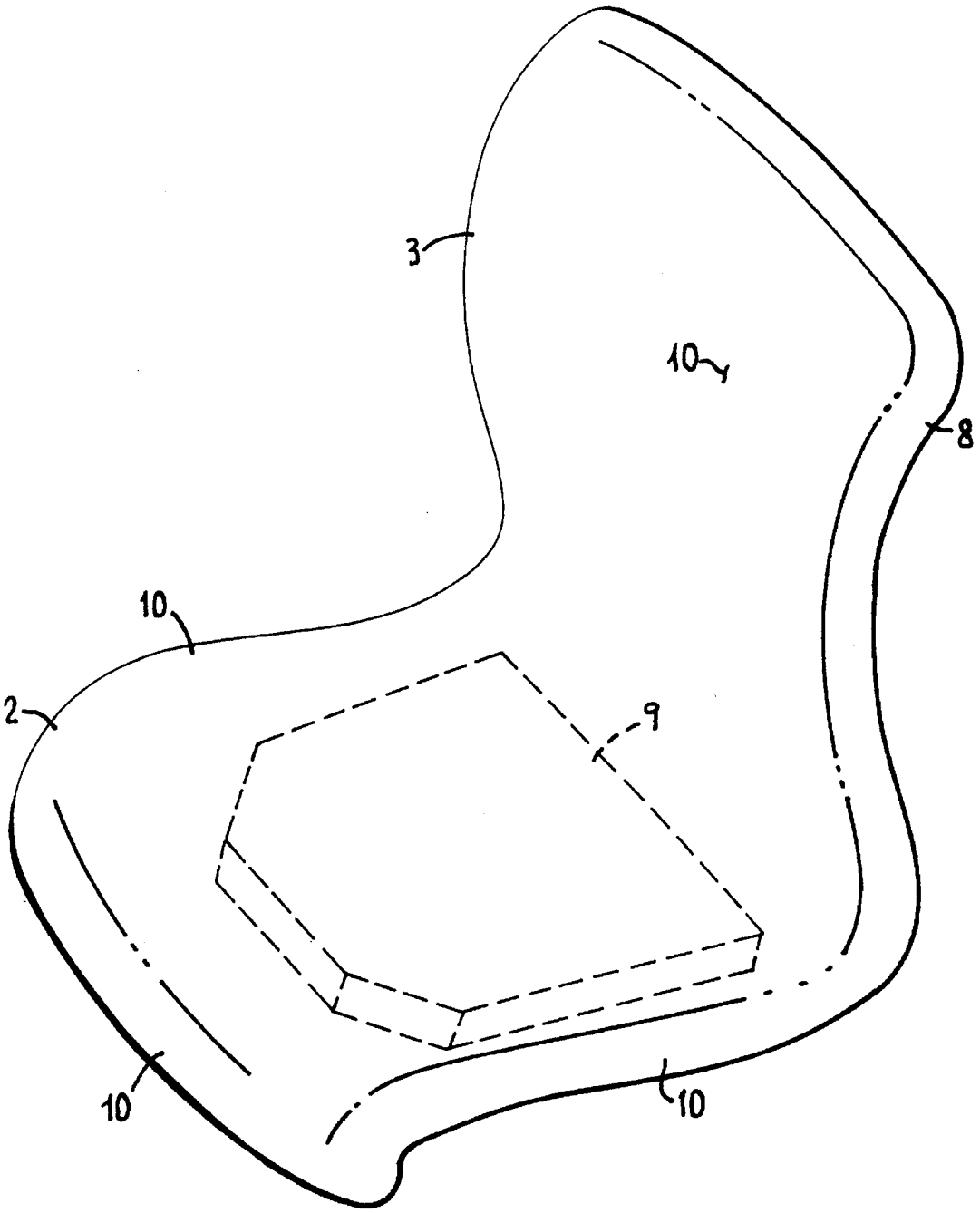
FIG. 2 is an isometric view of a composite chair cushion of this invention designed for the one piece office chair illustrated in FIG. 1, with an insert of foamed sheet material shown in phantom.

FIG. 2 illustrates an isometric view of a composite chair cushion 8 of this invention designed for the one piece office chair 1 illustrated in FIG. 1, showing, in phantom, the insert 9 of foamed material that is part of this invention. As illustrated in FIG. 2, the composite chair cushion 8 of this invention is comprised of an insert 9 of foamed material of a predetermined density and compressibility substantially in the center of the chair seat portion 2. The insert 9 is bonded to a foamed border material 10 that surrounds the border of the insert 9 and comprises the rest of the composite chair cushion 8, including the chair back portion 3.

The insert 9 is made of a foamed material, such as a polyurethane plastic foam, that is of a predetermined and density and compressibility for the chair. The foamed border material 10 that comprises the rest of the cushion 8 is of less density and greater compressibility that of the insert 9. The foamed border material 10 is also preferably a polyurethane plastic foam material that has been foamed in situ around the border of the insert 9 and in a mold cavity using a liquid foamable reaction mixture which provides for a good and effective chemical bond between the insert 9 and the foamed border material 10.

Figure 3:
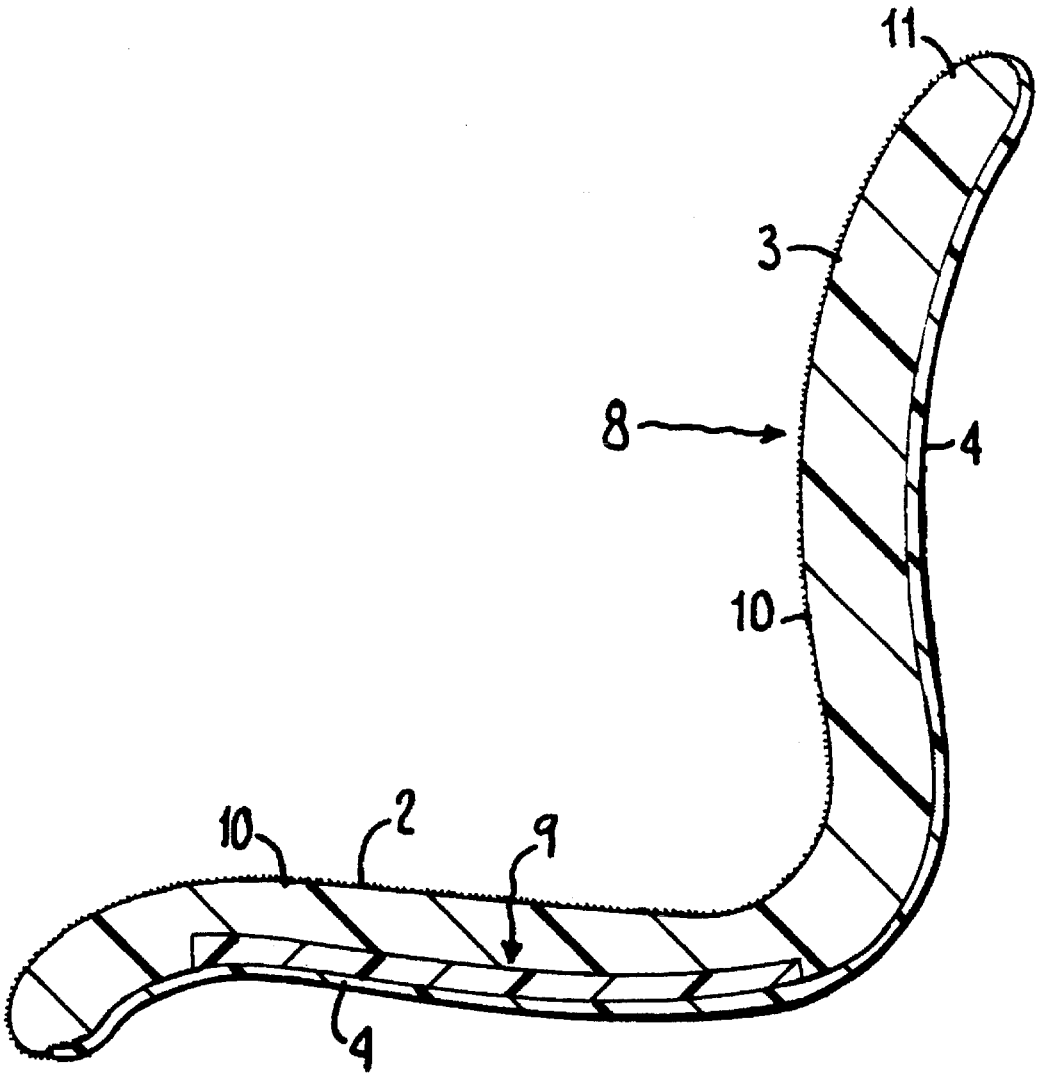
FIG. 3 is a cross-sectional view taken along section lines III—III shown in FIG. 1.

As shown in FIGS. 2 and 3, the insert 9 is preferably a rectangle that is pre-foamed to shape or cut from a sheet of foamed material of suitable density and compressibility. The density and compressibility of the insert 9 are selected for the type of chair and application and the weight of the user. As shown in FIG. 2, the insert 9 is placed substantially centrally in the seat portion 2 of the chair 1 so that it receives most of the weight of the user and the border material 10 extends from the border of the insert 9 to the side and front edges of the seat portion 2 and up into the back portion 3. If desired, a similar insert 9 could be placed in the back portion 3 of the chair cushion 8 but usually is not needed in most chair designs, since there is usually less pressure by the user on the back portion 3 than on the seat portion 2.

The use of the insert 9 enables a chair manufacturer to construct a chair having a thinner seat cushion than was possible before which not only provides a chair that is more attractive, easier to upholster but a chair that will meet ANSI HFS 100-1988 VDT code requirements for office chair seat height.

It has been discovered that an insert 9 of foamed material having a density of between 3.5 and 5.0 pounds per cubic foot and a compressibility of between 50 and 120 indention force deflection and a border material of a density of between 1.5 and 3.5 pounds per cubic foot and compressibility of between 25 and 50 indention force deflection, provides a composite chair cushion 8 that is comfortable to the user, long lasting and easily upholstered.

The preferred method for producing the composite foam chair cushion 8 of this invention comprises placing the insert 9 of foamed material in a predetermined position against one face of a cushion mold cavity and then introducing a liquid foamable reaction mixture into the mold cavity around the border of the insert 9 and into all portions of the mold cavity. The foamable reaction mixture is then allowed to foam and cure and in doing so, chemically bonds to the border of the insert 9, forming a composite chair cushion 8. The composite chair cushion 8 is then removed from the mold and upholstered with upholstery material 11 and used in the assembly of the chair.

As a specfic example of a composite chair cushion of this invention an insert 9 cut from a sheet of foamed polyurethane foam having a density of about 4.0 pounds per cubic foot and a compressibility of about 120 indention force deflection about 12 inches long and 15 inches wide and about ½ inch thick was placed against the one face of a mold for a chair cushion seat portion about 17 inches long and about 21 inches wide. After the mold was closed, a liquid polyurethane foaming mixture containing blowing agent was introduced into the mold and filled the rest of the mold cavity and bonded to the boarder of the insert 9 with a foamed polyurethane material 10 having a density of about 3.0 pounds per cubic foot and a compressibility of about 36 indentation force deflection. After the foamed material 10 had cured for about five minutes, the mold cavity was opened and the composite chair cushion 8 removed from the mold.

It will be understood that the embodiments that have been described and illustrated are provided for describing this invention and not for purposes of limitation.

I claim:

1. A composite foam chair cushion comprising an insert of a foamed material of a predetermined density and compressibility, the insert having a top surface a bottom surface and side surfaces, the side surfaces of the insert being bonded to and completely surrounded by a foamed border material of less density and greater compressibility than that of the insert.

2. The cushion of claim 1 which the insert and the foamed border material are polyurethanes.

3. The cushion of claim 1 in which the insert has a density of between 3.5 and 5.0 pounds per cubic foot and a compressibility of between 50 and 120 indentation force deflection and the border material has a density of between 1.5 and 3.5 pounds per cubic foot and a compressibility of between 25 and 50 indentation force deflection.

4. A composite foam chair cushion comprising a chair seat portion and a chair back portion, the seat and back portions being formed as a single integral unit including a foamed material, the foamed material consisting of a one-piece insert having a predetermined density and compressibility and a foamed border material having a lesser density and greater compressibility than that of the insert, the foamed border material bonded to and substantially surrounding the insert, wherein the foamed border material comprises the remainder of the chair seat and back portions.

5. The composite foam chair cushion according to claim 4 wherein the insert and the border material are polyurethane.

6. The composite foam chair cushion according to claim 5 wherein the predetermined density of the insert is about 3.5 to about 5.0 pounds per cubic foot.

7. The composite foam chair cushion according to claim 6 wherein the predetermined density of the insert is approximately 4.0 pounds per cubic foot.

8. The composite foam chair cushion according to claim 7 wherein the predetermined compressibility of the insert is about 50 to about 120 indentation force deflection.

9. The composite foam chair cushion according to claim 8 wherein the predetermined compressibility of the insert is approximately 120 indentation force deflection.

10. The composite foam chair cushion according to claim 9 wherein the density of the border material is about 1.5 to about 3.5 pounds per cubic foot.

11. The composite foam chair cushion according to claim 10 wherein the density of the border material is approximately 3.0 pounds per cubic foot.

12. The composite foam chair cushion according to claim 11 wherein the compressibility of the border material is about 25 to about 50 indentation force deflection.

13. The composite foam chair cushion according to claim 12 wherein the compressibility of the border material is approximately 36 indentation force deflection.

* * * * *